United States Patent [19]

Leavens et al.

[11] 4,222,363

[45] Sep. 16, 1980

[54] DRAFT TUBE FOR WOOD BURNING STOVES

[75] Inventors: Richard Leavens, Pownal, Vt.; Arthur D. Evans, Williamstown, Mass.

[73] Assignee: Mohawk Industries, Inc., Adams, Mass.

[21] Appl. No.: 929,186

[22] Filed: Jul. 28, 1978

[51] Int. Cl.[2] ..... F24C 1/14

[52] U.S. Cl. ..... 126/77

[58] Field of Search ..... 126/77, 76, 15 R

[56] References Cited

U.S. PATENT DOCUMENTS

| | | | |
|---|---|---|---|
| 693,735 | 2/1902 | Noxon | 126/77 |
| 827,424 | 7/1906 | Cutter et al. | 126/77 |
| 989,358 | 4/1911 | Hemphill | 126/77 |
| 1,512,275 | 10/1924 | Clark | 126/77 |
| 2,014,868 | 9/1935 | Steele et al. | 126/77 |
| 2,265,587 | 12/1941 | Waddell | 126/77 |

*Primary Examiner*—Carroll B. Dority, Jr.

*Assistant Examiner*—Wesley S. Ratliff, Jr.

*Attorney, Agent, or Firm*—Morse, Altman, Oates & Bello

[57] ABSTRACT

A draft tube in a wood burning stove is provided with a nozzle at the lower end thereof for directing a portion of the draft air downwardly against the charge of burning wood, coal, etc. and deflects a portion thereof sideways into a zone above the fuel to provide a more complete combustion of the rising volatiles. The nozzle may be integral with the draft tube or may be attached thereto as an accessory. The nozzle includes a tube having an outside diameter somewhat smaller than the inside diameter of the draft tube to define an annular passage therewith when the nozzle is installed. An annular radial flange is mounted on the outside and at the lower end of the nozzle and in line with the annular clearance whereby the major portion of the air and draft will flow directly downwardly through the nozzle tube while a portion passing through the annular passage will strike the flange and be deflected perpendicularly to the flow of the draft.

4 Claims, 9 Drawing Figures

DRAFT TUBE FOR WOOD BURNING STOVES

BACKGROUND OF THE INVENTION

1. Field of the Invention

This invention relates generally to wood burning stoves and the like and more particularly is directed towards a new and improved draft tube for use with wood burning stoves adapted to increase the efficiency of combustion of the fuels used therein.

2. Description of the Prior Art

Conventional wood and coal burning stoves are fabricated from cast iron and may be provided with doors at the front, as in a Franklin type stove, or it may be loaded at the top through a removable cover. Recently, stoves of this type have been fabricated by welding sheet metal so as to produce an essentially air-tight stove having improved burning efficiency. In stoves of this type combustion air is admitted to the fire box through draft tubes which allow fresh air to be brought in from outside the stove, down through the top and directly against the solid fuel being burned in the fire box. While such draft tubes serve to improve the combustion of the material being burned, a substantial portion of that material is wasted insofar as many of the volatiles are carried out of the stove without being burned.

Accordingly, it is an object of the present invention to provide improvements in stoves of the sort adapted to burn wood, coal and the like.

Another object of this invention is to provide improvements in draft tubes for wood and coal burning stoves to carry out more efficient combustion of the burnable material used in a stove.

Still another object of this invention is to provide a nozzle adapter for use on the draft tube of a wood burning stove to increase the efficiency thereof.

SUMMARY OF THE INVENTION

This invention features a draft tube nozzle arrangement for a wood burning stove, comprising at least one draft tube extending vertically downward from the top of the stove and terminating at a point above the fire box on which solid combustible materials such as wood, coal, or the like is deposited. When the charge of combustibles is ignited, smoke, gases and the like, vent out through the flue in the back of the stove. At the lower end of each draft tube is a nozzle adapted to direct a portion of draft air down and directly against the combustibles and another portion is deflected to the center of the stove to supply combustion air to superheated volatiles providing more complete combustion for available combustible materials. The nozzle includes a relatively short tubular member having an outside diameter smaller than the inside diameter of the draft tube to form an annular passage therewith and an annular flange mounted perpendicularly to the short tube and spaced from the end of the draft tube to the deflect a portion of the air perpendicularly to the draft tube while a major portion of the air flows through the short tube section down against the fuel.

DETAILED DESCRIPTION OF THE PREFERRED EMBODIMENTS

Figure 1:
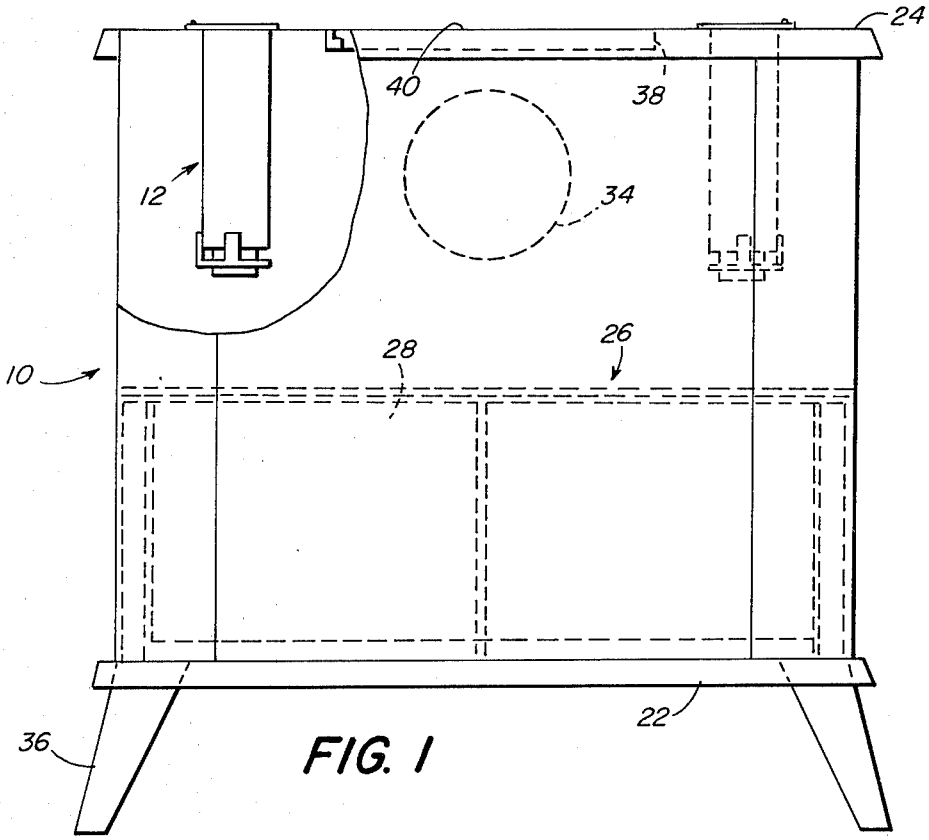
FIG. 1 is a view in elevation, partially cutaway, of a stove embodying a draft tube made according to the invention.
Figure 2:
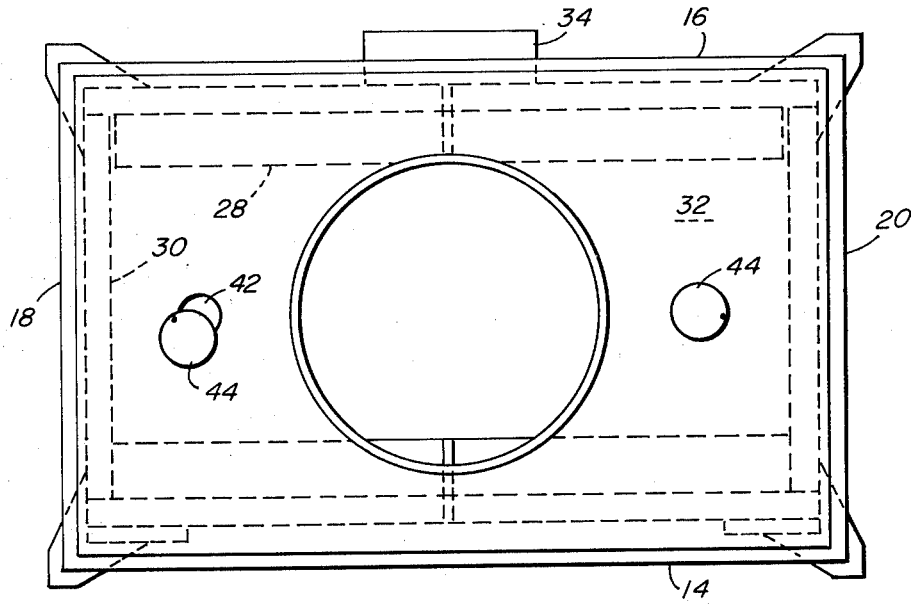
FIG. 2 is a top plan view thereof.

Referring now to the drawings and to FIGS. 1 and 2 in particular, there is illustrated a stove generally indicated by the reference character 10 and adapted to burn solid fuel such as wood, coal or the like and embodying a draft tube and deflecting nozzle assembly 12 made according to the invention. While the assembly 12 may be used for a variety of different stoves that burn solid fuel, it has been found to work particularly well with the stove 10 of the illustrated embodiment. The stove 10 is comprised of front and rear walls 14 and 16, side walls 18 and 20, a bottom wall 22, and a top wall 24. Preferably the stove walls are fabricated from sheet steel welded to form a substantially air tight enclosure. In practice, the stove includes a fire box 26 at the bottom of the stove and typically is lined with refractory blocks 28 and 30 at the sides and ends thereof. A hearth plate 32 is provided across the bottom of the fire box.

To use the stove, wood, coal or other combustible material is piled in the fire box 26 and, when ignited, oxygen is supplied through the draft tube assembly 12 with exhaust fumes exiting through a flue 34 provided in the back wall 16 and connected to a chimney or other suitable vent. The stove itself typically is supported on legs 36 and the stove may be charged through the top wall 24 by means of an access opening 38 normally covered by a removable lid 40.

Figure 3:
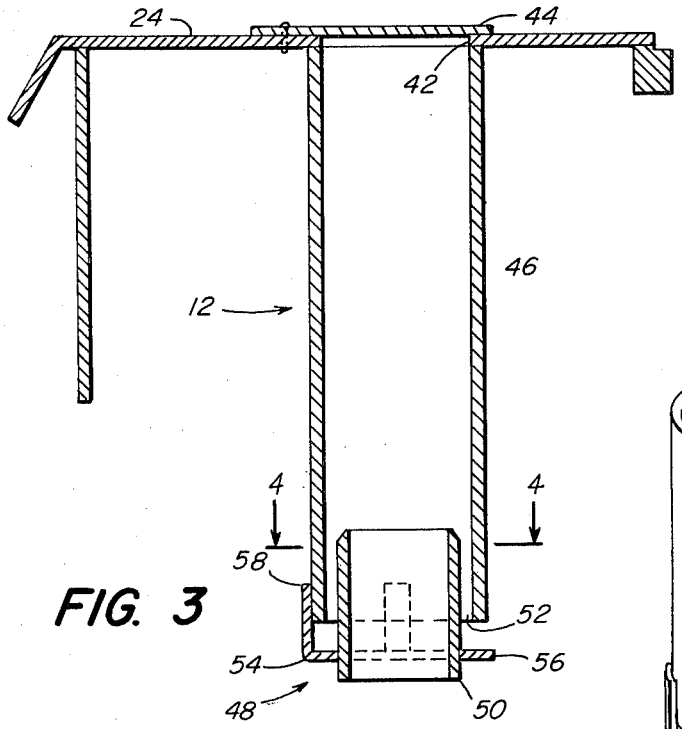
FIG. 3 is a detailed sectional view in side elevation of a draft tube made in according to the invention.
Figure 4:
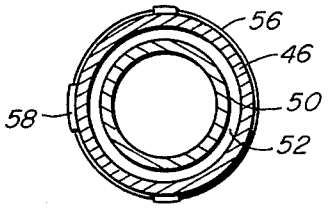
FIG. 4 is a cross-sectional view taken along the line 4—4 of FIG. 3.
Figure 5:
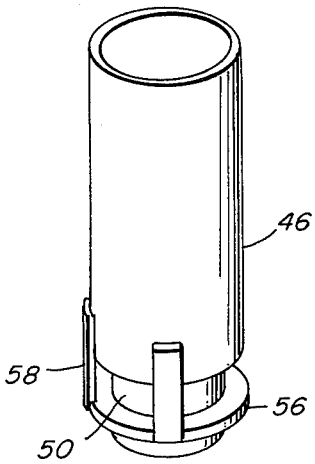
FIG. 5 is a view in perspective of a draft tube made according to the invention.
Figure 6:
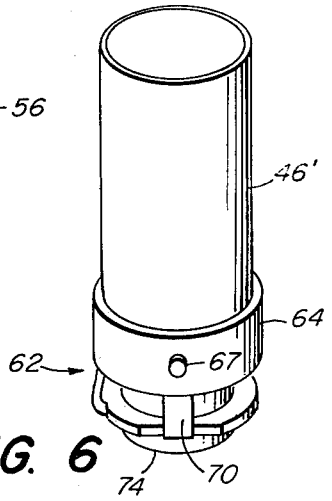
FIG. 6 is a view similar to FIG. 5 but showing a modification thereof.
Figure 8:
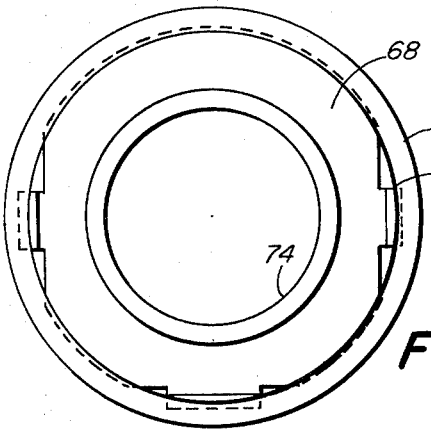
FIG. 8 is a top plan view thereof showing the diffusing ring in a flattened condition.
Figure 7:
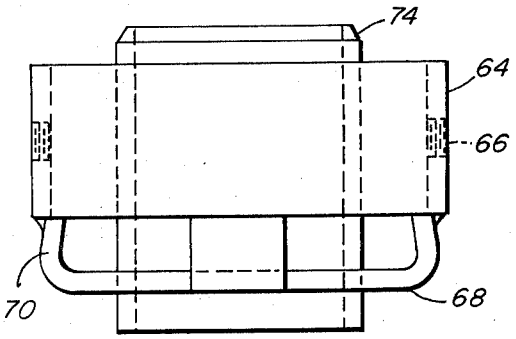
FIG. 7 is a view in side elevation of the FIG. 6 device.
Figure 9:
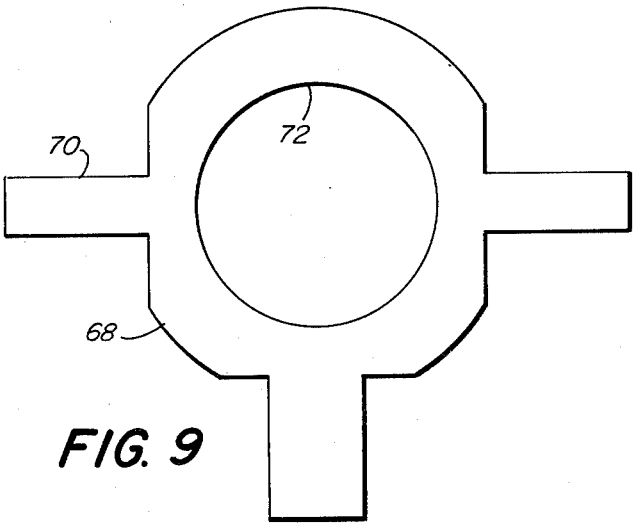
FIG. 9 is a plan view of a component of the illustrated embodiment.

In the illustrated emobidment two draft tube assemblies 12 are provided, one on each side of the lid 40. The upper end of each draft tube assembly 12 is in register with an opening 42 (FIG. 3) formed in the top wall 24. The opening 42 may be operated in the fully open condition for the maximum air draft down through the tube to the fire box or the opening 42 may be closed to any degree by means of a cover 44 movably mounted on the top wall 24. The cover 44 may be pivoted to the top wall or may be slidably mounted thereon. By adjusting the position of the cover 44 so as to control the size of the opening of the draft tube, the amount of air into the fire box is also controlled whereby combustion may be accellerated or retarded according to the amount of heat required.

In practice, the draft tube assembly 12 is comprised of a main draft tube 46, typically—7½" in length with an inside diameter of 2". The tube is fabricated from metal and preferably of a steel capable of withstanding the high temperatures experienced inside the stove. The upper end of the tube 46 is mounted to the top wall by welding or the like and lower end carries a nozzle unit 48 comprised of a relatively short tubular section 50 telescopically mounted within the lower end of the tube 46. The tubular section 50 typically is 2" in overall length and has inside diameter of perhaps 1.375" to form an annular passage 52 with the lower inner walls of the tube 46. The tube section 50 is coaxially mounted within the draft tube 46 by means of a bracket 54 which includes a diffusing ring in the form of an annular flange 56 horizontally disposed with respect to the vertical draft tube 46 and tube section 50 and vertical tab legs 58 secured to the outer surface of the lower end of the draft tube 46 by welding or the like.

In the illustrated embodiment three tab legs 58 are spaced about the annular flange 56 at 90° intervals and support the tube section 50 so that approximately $\frac{3}{4}$" of the lower end of the tube section 50 extends below the lower end of the draft tube while approximately 1-$\frac{1}{4}$" extends telescopically up into the tube.

In the preferred embodiment, the nozzle 48 when assembled to the lower end of the tube 46 forms the annular passage 52. Typically the passage 52 has a width of perhaps 0.188" formed by the clearance between the tube 50 and the tube 46. The flange 56 is spaced from the lower end of the draft tube 46 typically by a distance of perhaps 0.375". The foregoing dimensions are only by way of example and can be varied according to various factors such as the number of draft tubes provided for a particular stove, the size of the stove and the like. However, for a stove with two draft tubes of the sort illustrated in FIG. 1, the foregoing dimensions have provided satisfactory performance.

In operation with wood or other combustible solid burning material air will flow down through the draft tube 46 with a major portion of the air passing through the nozzle tube 50 directly against the top of the solid fuel to provide the required oxygen for combustion. However, a portion of draft air will flow through the annular passage 60 and strike the annular flange of the diffusing ring 56 to be deflected in a generally perpendicular direction to flow outwardly towards the center of the stove. Insofar as the nozzle is supported by the three tabs 58 located to the front, rear and one side of the nozzle, the inward side closest to the center of the stove is unrestricted so that more deflected air will flow towards the center of the stove than elsewhere. This air will combine with volatiles and flames raising above the solid fuel towards the flue and will ensure more complete combustion of superheated volatiles which otherwise would go unburned. This produces a more efficient combustion of a given amount of fuel and generates more heat for the stove. Also, since more complete combustion is obtained for the fuel the amount of pollutants is reduced and the flue, as well as any connected chimney, tends to remain cleaner than would otherwise be the case.

Referring now to FIGS. 6 through 9, there is illustrated a modification of the invention, and in this embodiment there is shown an adapter nozzle 62 that may be mounted on an existing air draft tube 46' to convert the draft tube 46' into one having the capabilities of the principal embodiment. The nozzle attachment 62 is comprised of an outer annular sleeve 64 dimensioned to slip over the lower end of the draft tube 46' and is provided with tapped holes 66 spaced about the sleeve to receive set screws 67 by means of which the nozzle may be secured to the tube 46. The nozzle also includes a diffusing ring 68, preferably formed with three upwardly bent tabs 70 welded or otherwise secured to the sleeve and formed with a central opening 72 in which is mounted a tube 74 similar to the tube 50 of the principal embodiment. The diffusing ring 68 is spaced from the lower edge of the sleeve 64 to provide a clearance which is unobstructed on one side thereof and, in practice, the nozzle adapter is installed so that the unobstructed side is directed towards the center of the stove as in the principal embodiment. The tube 74, when the nozzle is installed, will extend up into the lower end of the draft tube in the same manner as described above the device is otherwise functionally equivalent to the principal embodiment.

The nozzle, in either embodiment, provides a simple means for improving the efficiency of wood and coal burning stoves of the type described and, by producing more complete combustion of the volatiles, more heat is produced along with a reduction in pollution.

While the invention has been described with particular reference to the illustrated embodiments, numerous modifications thereto will appear to those skilled in the art.

Having thus described the invention, what we claim and desire to obtain by Letters Patents of the United States is:

1. A nozzle for a stove adapted to burn solid fuel and having a vertically mounted draft tube extending through an upper wall of said stove in the direction of said fuel, comprising (a) air draft diffuser means defining a pair of air flow paths one along the longitudinal axis of said tube and another generally perpendicular thereto for deflecting one portion of air flowing through said draft tube away from said fuel towards a zone above said fuel and directing another portion of air directly against said fuel, and, (b) mounting means connected to said diffuser means for mounting said diffuser means to said draft tube, (c) said diffuser means including a tubular member having an outside diameter less than the inside diameter of said draft tube to define an annular passage therewith when said member is mounted coaxially therein and a flange mounted perpendicularly to the axis of said member and about the outer surface thereof in line with said passage, said mounting means adapted to mount said member at the inner end of said tube and said flange spaced from the end of said tube, (d) said flange defining with the end of said tube an annular radial port that is substantially open over one major portion thereof and at least partially obstructed over another major portion thereof, the open portion of said port being oriented towards said zone.

2. A nozzle according to claim 1 wherein said mounting means includes spaced tabs extending from said flange and secured to said tube.

3. A nozzle according to claim 1 wherein said mounting means includes a sleeve dimensioned to slip over the end of said tube and connected to said flange and fastening means on said sleeve for detachably connecting said sleeve to said tube.

4. A nozzle according to claim 1 wherein said flange is annular and the outer edges thereof extend beyond the circumference of said tube.

* * * * *